United States Patent [19]

Kostyshin et al.

[11] 4,252,891

[45] Feb. 24, 1981

[54] METHOD OF MANUFACTURING EMBOSSED ARTICLES OF PRESET CONFIGURATION

[76] Inventors: Maxim T. Kostyshin, ulitsa Melnikova, 46, kv. 40; Petr F. Romanenko, prospekt Nauki, 86/90, kv. 68, both of Kiev, U.S.S.R.

[21] Appl. No.: 820,134

[22] Filed: Jul. 29, 1977

Related U.S. Application Data

[63] Continuation of Ser. No. 651,138, Jan. 21, 1976.

[51] Int. Cl.[2] ..... G03C 5/00

[52] U.S. Cl. ..... 430/323; 430/273; 430/297; 430/313; 430/318; 430/325; 430/350; 430/353; 430/495

[58] Field of Search ..... 427/56; 96/35, 36; 430/273, 297, 313, 318, 325, 350, 353, 495

[56] References Cited

U.S. PATENT DOCUMENTS

| | | | |
|---|---|---|---|
| 3,520,691 | 7/1970 | Scheler et al. | 96/75 |
| 3,637,381 | 1/1972 | Hallman et al. | 96/35 |
| 3,996,057 | 12/1976 | Kawaziri et al. | 96/484 |

*Primary Examiner*—Bernard D. Pianalto

*Attorney, Agent, or Firm*—Lackenbach, Lilling & Siegel

[57] ABSTRACT

A method of manufacturing embossed articles of a preset configuration utilizing a material sensitive to electromagnetic and corpuscular radiation. The method consists in coating a backing with a layer of metal, applying a barrier layer to the metal layer, coating the barrier layer with a layer of inorganic matter capable of interacting chemically with the metal layer and forming the products of interaction whose physical and chemical properties differ from those of the metal layer and the layer of inorganic matter, in projecting a picture of a preset configuration on the applied layers, exposure, and in the removal of the unnecessary portions of the layers until an embossed article of a preset configuration is produced. The barrier layer is made of a material different from the layer of metal and the layer of inorganic matter and inert with respect to the metal layer and the layer of inorganic matter in absence of electromagnetic and corpuscular radiation. The thickness of the barrier layer is made sufficient to prevent chemical interaction between the metal layer and the layer of inorganic matter in absence of electromagnetic and corpuscular radiation and permitting such interaction in presence of electromagnetic and corpuscular radiation.

29 Claims, 28 Drawing Figures

METHOD OF MANUFACTURING EMBOSSED ARTICLES OF PRESET CONFIGURATION

This is a continuation of application Ser. No. 651,138 filed Jan. 21, 1976 now abandoned.

The present invention relates to the methods of manufacturing embossed articles of a preset configuration with the use of materials sensitive to electromagnetic and corpuscular (actinic) radiation. This method can be used for making holograms, diffraction gratings, polarizers of electromagnetic radiation, phototemplets, elements of microcircuits, printed plates, memory cells, engraving plates, etc.

Known in the previous art is a method of manufacturing embossed articles of a preset configuration with the use of a material sensitive to electromagnetic radiation (U.S. Pat. No. 3,637,381 filed July 3, 1969) which comprises the following operations: applying a metal layer to a backing, coating the metal layer with a layer of inorganic matter which is capable of interacting chemically with the metal layer under the effect of electromagnetic radiation and forming the products of interaction whose physical and chemical properties differ from those of the metal and inorganic matter layers, the material of the metal layer being selected from a group including Ag, Cu, Pb, Cd, Zn, Fe, Sn, As, Bi, Co, Ge, Mg, Hg, Ni, Se, Si, Tl, Te and V, whereas the material of the layer of inorganic matter consists of an element or a compound selected from a group including S and Se compounds or mixtures M-X and compounds or mixtures M-X-Y where M is the metal selected from the group consisting of As, Sb, Bi, Se, Te, Cu, Zn, Cd, Hg, Pl, Cr, Ga, In, Tl, Ge, Sn, Fe, Co, Ni and Ag while X-Y are the elements selected from a group comprising halides, sulphur, selenium and tellurium; projecting on the applied layers a pattern of a preset configuration, exposure and removal of unnecessary portions of the layers until an embossed article of a preset configuration is produced.

In the known method of manufacturing embossed articles the exposure is effected by using highly powerful fluxes of electromagnetic radiation because the materials sensitive to electromagnetic radiation in this method comprise a metal layer consisting of any one of the above-listed elements except for Ag and Cu and possess a very low sensitivity ($>J/cm^2$). Therefore, it is very difficult to make a hologram of sufficient size (e.g. $60\times90$ $mm^2$) by the known method, even with the employment of superpowerful lasers.

Besides, in the known method of manufacturing embossed articles it is practically impossible to use electromagnetic radiation of the red and near infra-red regions of the spectrum. This is attributable to the fact that the chemically stable materials sensitive to electromagnetic radiation and used in the known method are sensitive only in the ultraviolet, violet, blue and green regions of the spectrum whereas in the red and near infra-red regions they are practically insensitive (for example, $As_2S_3$-Ag, $As_2S_5$-Ag, (As-S-J)-Ag, etc.) so that the manufacture of embossed articles with the use of such materials according to the known method is difficult to realize.

Even if the metal layer consists of silver, still the streams of electromagnetic radiation must be highly intensive since the chemically stable materials (inorganic matter—silver) feature a very low sensitivity (about 0.1-1.0 $J/cm^2$). If the metal layer consists of copper, the resultant materials sensitive to electromagnetic and corpuscular radiation (inorganic matter—copper) are unstable in time due to intensive spontaneous chemical interaction between the layers of copper and inorganic matter.

An object of the present invention is to provide a method of manufacturing embossed articles of a preset configuration with the use of materials sensitive to actinic radiation which makes it possible to use weaker electromagnetic and corpuscular fluxes during exposure than those required in the known methods.

Another object of the invention is to provide a method utilizing the radiation of the red and near infrared regions of the spectrum for exposure.

Still another object of the invention is to provide a method which would allow the employment of a wide range of inorganic substances for the layer of inorganic matter.

These objects are achieved by providing a method comprising the following operations: application of a metal layer to a backing, coating said metal layer with a layer of inorganic matter capable of interacting chemically with said metal layer and of forming the products of interaction whose physical and chemical properties differ from those of said metal layer and the layer of inorganic matter, projecting a pattern of a preset configuration on said applied layers, exposure, and removal of unnecessary portions of said layers until an embossed article of a preset configuration is produced wherein, according to the invention before applying the layer of inorganic matter to the metal layer, the layer is coated with a barrier layer consisting of a matter differing from that of said metal layer and inorganic matter layer and being inert with respect to the metal and inorganic matter layers in absence of electromagnetic and corpuscular radiation, the thickness of said barrier layer being sufficient to prevent chemical interaction between the layers of metal and inorganic matter in absence of electromagnetic and corpuscular radiation and permitting such interaction in presence of electromagnetic and corpuscular radiation while during the removal of unnecessary portions of the layers the unnecessary portions of the barrier layer are removed too.

The above operations may be performed in a different sequence, by a method comprising the following operations: application of a layer of inorganic matter to a backing, coating layer of inorganic matter with a metal layer capable of interacting chemically with the layer of inorganic matter and of forming the products of interaction whose physical and chemical properties differ from those of the layer of inorganic matter and metal layer, projecting a pattern of a preset configuration on the applied layers, exposure, and removal of the unnecessary portions of the layers until an embossed article of a preset configuration is obtained wherein, according to the invention, before applying the layer of metal to the layer of inorganic matter the latter is coated with a barrier layer consisting of a substance which differs from the material of the metal layer and the layer of inorganic matter and is inert with respect to the metal and inorganic layers in absence of electromagnetic and corpuscular radiation, the thickness of the barrier layer being sufficient to prevent chemical interaction between the layer of metal and the layer of inorganic matter in absence of electromagnetic and corpuscular radiation and permitting such interaction in presence of electromagnetic and corpuscular radiation while the removal of unnecessary portions of the layers is accompanied by removing the unnecessary portions of the barrier layer too.

To simplify the manufacturing process it is practicable that the barrier layer should be applied by treating the surface of the metal layer in the atmosphere of gaseous oxygen and/or fluorine, chlorine, bromine, iodine, sulphur, selenium, tellurium.

To improve the quality of the produced articles it is most practicable that the barrier layer should be applied by deposition in vacuo.

The barrier layer can also be applied by chemical precipitation.

To simplify the manufacture of embossed articles it is preferable that the barrier layer should be applied by dipping the work into a solution containing the substance of the barrier layer.

It is practicable that the barrier layer should be applied by dipping the work into an active medium capable of interacting with the layer of metal and forming a barrier layer. The barrier layer can also be applied by pouring.

In cases when the exposure is followed by removing the layer of inorganic matter which has not reacted chemically with the metal layer, the high quality of embossed articles will be achieved by removing the barrier layer at the nonexposed points after the removal of the layer of inorganic matter.

In cases when the exposure is followed by removing the layer of metal which has not reacted chemically with the layer of inorganic matter it is practicable that the barrier layer at the nonexposed points should be removed after removing the metal layer.

To obtain high quality of the embossed articles it is most practicable that the unnecessary portions of the barrier layer should be removed by chemical etching.

To simplify the manufacture of embossed articles it is preferable that the unnecessary portions of the barrier layer should be removed mechanically.

The unnecessary portions of the barrier layer can also be removed by thermal sublimation.

During the exposure it is expedient that an electric field be applied to the material with a view to increasing its sensitivity.

The method of manufacturing embossed articles of a preset configuration realized in accordance with the present invention features the following advantages. Firstly, the exposure in this method is effected by weaker electromagnetic and corpuscular fluxes than those required in the known method. Secondly, the method according to the invention utilizes electromagnetic radiation of the red and near infra-red regions of the spectrum. And thirdly, this method utilizes the layers of inorganic matter and metal consisting of a wide range of substances which could not be used in the known method because of intensive and uncontrollable chemical reactions between the layer of metal and that of inorganic matter.

Now the invention will be described in detail by way of examples with reference to the accompanying drawings, in which.

Figure 1:
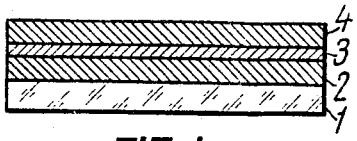
FIG. 1 shows the arrangement of the layers of the material sensitive to electromagnetic and corpuscular radiation and applied to the backing.

FIG. 1 shows a backing 1 which is coated, according to the invention, with a metal layer 2, barrier layer 3 and a layer 4 of inorganic matter capable of interacting chemically with the metal layer 2 both under the effect of electromagnetic and corpuscular radiation and without it and or forming the products of interaction whose physical and chemical properties differ from those of the metal layer 2 and the layer 4 of inorganic matter. The backing is made of dielectrics (glass, quartz, mica, ceramics, etc.), semiconductors, metals, organic films (e.g. teflon, terilen, etc.), paper, wood, etc. The thickness and size of the backing 1 are not specified and must be selected depending on the application and size of the article to be manufactured. The surface finish of the backing to be coated with the metal layer also depends on the characteristics of the article. The surface of the backing 1 may be rough, ground, polished, pickled, etc.

The metal layer 2 may consist of silver, copper and other metals and their alloys and compounds which are capable of interacting chemically with the layer 4 of inorganic matter both under the effect of electromagnetic and corpuscular radiation and without it, and of forming the products of interaction. The thickness of the metal layer 2 may vary from a few tens of Ångstroms to a few millimeters. The most acceptable thicknesses of the metal layer 2 lie in the range of 300 to 2000 Å. The barrier layer 3 is usually made of a substance which differs from the substance of the metal layer 2 and the layer 4 of inorganic matter and is inert with respect to the metal layer 2 and the layer 4 of inorganic matter in absence of electromagnetic and corpuscular radiation, the thickness of the barrier layer 3 being sufficient to prevent chemical interaction between the metal layer 2 and the layer 4 of inorganic matter in absence of electromagnetic and corpuscular radiation and permitting such interaction in presence of electromagnetic and corpuscular radiation. The barrier layer 3 can be made of many inorganic and organic substances. For example, it can be made of metals such as Au and/or Zn, Cd, Mg, Al, Ga, In, Tl, Si, Ge, Sn, Pb, As, Sb, Bi, Ti, V, Cr, Mn, Fe, Co, Ni, Mo, Ta, W, Re, Os, Ir, Pt, their alloys as well as the oxides, sulphides, tellurides, halides and phosphides of these metals.

The barrier layer 3 can also be made of such organic substances as polyethylene, polystyrene, polypropylene, polymethacrylate, polycarbonates, polyvinyl chlorides, polytetrafluoethylene, epoxy resins, colophony, anthracene, etc. The thickness of the barrier layer 3 should vary from 20 to 300 Å. Experiments have shown that the most acceptable thickness of the barrier layer is from 30 to 150 Å.

The layer 4 of inorganic matter should be made of inorganic substances containing sulphur, selenium, selenium and halogen (for example, S, Se, Se-J, Se-Br, Se-Cl, $Bi_2S_3$, $As_2Se_3$, $Bi_2Se_3$, GeSe, $GeSe_2$, As-Se-J, As-Se-Br, Bi-Se-J, Sb-Se-J, $KAsSe_2$, $NaAsSe_2$ and others). The thickness of the layer 4 of inorganic matter should range from a few tens of Ångstroms to a few millimeters. The most acceptable thicknesses of the layer 4 range from 200 to 3000 Å.

The method of manufacturing embossed articles of a preset configuration according to the invention includes consecutive application to the backing 1 (FIG. 1) of a metal layer 2, barrier layer 3 and layer 4 of inorganic matter. The methods of application of these layers may vary (oxidation of the surface of the metal layer, application in vacuo, chemical precipitation, dipping into a solution, pouring, etc.). For example, all the three layers are applied consecutively in a vacuum. This produces the articles of an extra-high quality. For example, the polished glass backing is coated in vacuum ($2.10^{-5}$ mm Hg) with a silver layer 2, 2000 Å thick, a barrier layer 3 of arsenic trisulphide 40 Å thick and a layer 4 of arsenic triselenide 700 A thick.

Using a vacuum installation with three heaters it is possible to carry out all the three operations without devacuumization. This ensures adequate adhesion between the layers and prevents impurities contained in the ambient medium from getting on the boundaries between the layers.

In another example the metal layer 2 is applied to the backing in a vacuum, the barrier layer 3 is applied by immersing the backing 1 with the metal layer 2 into a solution (e.g. weak solution of colophony in alcohol) after which the layer 4 of inorganic matter is again applied in vacuo.

In the third case the metal layer 2 is applied by chemical precipitation whereas the barrier layer 3 and the layer 4 of inorganic matter are applied in vacuo.

There also are other combinations of methods used for application of individual layers.

The methods of manufacturing embossed articles of a preset configuration according to the invention may also presuppose the case when the metal layer 2 is rather thick (e.g. metal foil or plate) and itself serves as a backing. In this case the regular backing 1 (FIG. 1) is absent. For example, a copper plate 1 mm thick is coated in vacuum ($2/10^{-5}$ mm Hg) is coated with a barrier layer 3 of chromium 30 Å thick followed by application of a layer 4 of arsenic trisulphide 650 Å thick.

Figure 2:
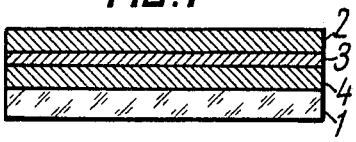
FIG. 2 shows the arrangement of the layers sensitive to electromagnetic and corpuscular radiation and applied to the backing in the reverse order.

The method of manufacturing embossed articles of a preset configuration according to the invention comprises also application of layers to the backing in a reverse order. Thus, FIG. 2 illustrates a backing 1 which has been coated first with a layer 4 of inorganic matter, then with a barrier layer 3 and, finally, with a metal layer 2. For example, a glass backing 1 is coated consecutively in vacuum ($1.10^{-5}$ mm Hg) with a layer 4 of germanium diselenide 2000 Å thick, a barrier layer 3 of arsenic trisulphide 50 Å thick and a silver layer 2 500 Å thick. The use of the material with the reverse arrangement of layers is useful, for example, in manufacturing holographic diffraction gratings since it permits making an article with a deep relief and, consequently, possessing a high diffraction efficiency.

Figure 3:
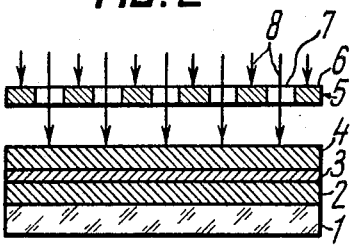
FIG. 3 is the diagram of exposure of the material shown in FIG. 1.

FIG. 3 shows the same sequence of layers as in FIG. 1 and a diagram of projecting a pattern on it, and exposure. The material is subjected to actinic radiation 8 through a stencil 5 which has nontransparent portions 6 and transparent portions 7 to suit the desired configuration of the embossed article being made. The stencil 5 can be constituted by a conventional photographic negative, a perforated metal mask either freely mounted or rigidly secured to the backing which is transparent for actinic radiation 8. Electromagnetic and corpuscular radiation 8 is provided by light (ultra-violet, visible, infra-red electronic fluxes, X-rays, etc. The pattern is projected on the layers arranged as shown in FIGS. 1 and 2 either by the method of contact printing or by means of optic projection (for example, with the aid of a photographic enlarger or, when recording holograms, by projecting and interference image formed by two laser beams).

The layers arranged as shown in FIGS. 1 and 2 may be subjected to electromagnetic radiation either from the side of the upper layers (layer 4 in FIG. 1 and layer 2 in FIG. 2) or from the side of the backing, provided it passes actinic radiation.

If radiation is directed from the side of the layer 4 of inorganic matter, as illustrated in FIG. 3, the thickness of the layer 4 should be such as to permit actinic radiation to reach the boundary between the layers 4, 3 and 2. Otherwise, if the layer 4 is excessively thick, actinic radiation will be absorbed mainly far from the above-mentioned boundaries, thus giving but little stimulation of chemical interaction between the layers 4 and 2. In this case the most acceptable thicknesses of the layer 4 will lie in the range of 100–3000 Å.

If radiation is directed from the side of the metal layer 2 (for example, for the arrangement of layers illustrated in FIG. 2), the layer 2 must be semi-transparent to actinic radiation. In this case the thickness of the metal layer 2 should vary from a few tens of Ångstroms to 600–700 Å.

Figure 4:
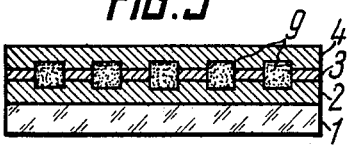
FIG. 4 shows the material after its exposure to actinic radiation.

In the course of exposure the layer 4 of inorganic matter at the points subjected to electromagnetic or corpuscular radiation enters a chemical interaction with the metal layer 2 and forms the products of interaction 9 as shown in FIG. 4. The thickness of the products of interaction 9 is directly proportional to the duration of exposure, i.e. it is the product of lighting intensity and the time of radiation.

FIG. 4 illustrates an occasion on which a part of the layer 4 of inorganic matter under the effect of electromagnetic radiation has entered into chemical interaction with a part of the metal layer 2. Depending on the thickness of the layers 4 and 2 and on the time of exposure, the products 9 of interaction are formed, if necessary, throughout the thickness of the layer 4 or 2 or both. In all cases the products 9 of interaction include parts of the barrier layer 3 that have been located in the points subjected to irradiation. Depending on the material the barrier layer consists of, said parts of the barrier layer 3 either form, simultaneously with the layer 4, the products 9 of interaction with the metal layer 2, or (when the barrier layer 3 consists of metal) they form, together with the layer 2, the products 9 of interaction with the layer 4 of inorganic matter. In the third case, if the material of the barrier layer 3 is incapable of entering into chemical interaction with the layers 2 and 4 under the effect of electromagnetic and corpuscular radiation, the material of the barrier layer penetrates into the products 9 of interaction.

Figure 5:
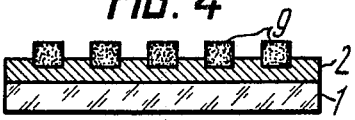
FIG. 5 shows the material after the removal of the layer of inorganic matter and of the barrier layer at the nonexposed points.

Shown in FIG. 5 is the same arrangement of layers as in FIG. 4 after the removal of the layer 4 of inorganic matter that has not entered into chemical interaction with the layer 2 under the effect of electromagnetic and corpuscular radiation. The layer 4 is removed by chemical etching, i.e. with the aid of a solution which dissolves the layer 4 of inorganic matter. For example, if the layer 4 is made of such inorganic compounds as arsenic trisulphide, arsenic triselenide or germanium diselenide, the layer 4 that has not entered into chemical interaction with the layer 2 is removed with the aid of a 5–10% water solution of potassium hydroxide, sodium hydroxide, etc. The time required for removing the layer 4 depends on its thickness, on the concentration and temperature of the solution and varies from a few seconds to several minutes. For example, if the layer 4 is made of arsenic trisulphide and is 1000 Å thick, the time for its removal is a 1% water solution of potassium hydroxide will be equal to a few seconds.

As we can see from FIG. 5, the barrier layer 3 at the points not subjected to irradiation has also been removed. The barrier layer 3 can be removed either simultaneously with the layer 4, or separately. For example, if the layer 4 consists of arsenic triselenide and the barrier layer 3 consists of germanium disulphide, then the layer 4 and the barrier layer 3 can be stripped simultaneously with the and of a 5% water solution of potassium hydroxide.

If the method of manufacturing embossed articles of a preset configuration utilizes the arrangement of layers shown in FIG. 2, the exposure is followed by first stripping the metal layer 2 that has not entered into chemical interaction with the layer 4 of inorganic matter. The metal layer 2 can be stripped with the solution of acids, such a sulphuric, nitric, hydrofluoric, muriatic, etc. For example, if the layer 2 consists of silver, the portion of this layer can be removed with the aid of an acid-chrome mixture ($H_2SO_4+K_2Cr_2O_7$). Depending on the material of the barrier layer 3, it is removed from the points not subjected to radiation either simultaneously with the layer 2 or separately. If the barrier layer 3 consists of metal, it is removed simultaneously with the layer 2 with the aid of solutions of acids, such as sulphuric, nitric, hydrofluoric, muriatic, etc. If the barrier layer 3 is selected from glasslike chalcohenide materials, it is removed with the aid of a water solution of potassium hydroxide, sodium hydroxide, ammonium hydroxide, etc.

When the barrier layer 3 is made of organic substances, it is removed from the points not subjected to radiation by means of organic solvents (benzene, acetone, alcohol, ether, carbon tetrachloride, turpentine, etc.). For example, if the barrier layer 3 consists of polyethylene, it is stripped with the aid of carbon tetrachloride, while the barrier layer made of colophony is stripped by means of ethyl alcohol, etc.

FIG. 5 can already be regarded as a finished embossed article, sectionalized. The relief is formed by the products 9 of interaction standing out above the surface of the metal layer 2. This method has been used for making amplitude-phase holograms of three-dimensional objects, diffraction gratings and other holographic articles.

The holographic amplitude-phase diffraction gradings have been made by projecting an interference picture made by two coherent beams of a laser on the combination of layers shown in FIG. 1 or 2, by exposure and subsequent removal of the layer 4 of inorganic matter and portions of the barrier layer 3 from the points not subjected to irradiation.

By changing the angle between the laser beams we changed the spatial frequency of the diffraction gratings. This method of making diffraction gratings is simple and does not call for the use of intricate equipment.

According to the invention, the diffraction gratings can be made with the aid of lasers emanating radiation not only in the ultraviolet, blue and green regions of the spectrum, but also in the red and near infra-red regions, for example helium-neon lasers (6328 Å). This is quite convenient since the helium-neon lasers feature a long service life and a considerably stable radiation. The application of the barrier layer 3 to the metal layer 2 before coating it with the layer 4 of inorganic matter has made it possible to use in the method of manufacturing embossed articles of a preset configuration according to the invention, a number of inorganic substances for the layer 4 which, together with the metal layer 2, forms a material which is also sensitive in the red and near infra-red regions. Without the application of the barrier layer 3 the manufacture of diffraction gratings with the aid of a helium-neon lasers had met with great difficulties ensuring from chemical instability of the material which is sensitive to electromagnetic and corpuscular radiation.

Figure 6:
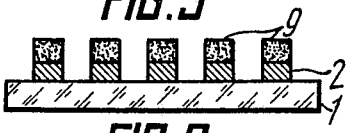
FIG. 6 shows the material after the removal of the metal layer at the points not protected by the products of interaction.

It should be noted that the products 9 of interaction which form the relief of the article illustrated in FIG. 5 are apt to change their properties in the course of storage and employment of the embossed article which leads to gradual deterioration of said article. In order to produce an embossed article of a preset configuration with more stable properties in time and, in a number of cases, with a deeper relief, the embossed article shown in FIG. 5 is further pickled, for example by removing the metal layer 2 at points not protected by the products 9 of interaction (FIG. 6). In this case the products 9 of interaction are used as a protective mask during pickling of the metal layer 2. The metal layer 2 is stripped with solutions of acids such as sulphuric, nitric, hydrofluoric, muriatic, a chrome-acid mixture ($H_2SO_4+K_2Cr_2O_7$), etc. For example, a layer of silver is removed with the aid of a 1% water solution of nitric acid or with a chrome-acid mixture ($H_2SO_4+K_2Cr_2O_7$).

After the removal of the metal layer 2 at the points not protected by the products 9 of interaction, said products are also removed.

Figure 7:
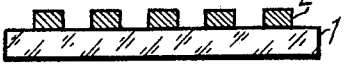
FIG. 7 shows the finished embossed article.

FIG. 7 shows a finished embossed article after the removal of the products 9 of interaction shown in FIG. 6. The products 9 of interaction are removed by chemical etching, mechanical erasing, by thermal methods, etc. Chemical etching is performed with the aid of concentrated water solutions of alkalies, ammonium hydroxide, etc. In a number of cases the products 9 of interaction are removed mechanically by rubbing them off with fabric and thermally, by heating them to a temperature at which they are sublimated from the surface of the metal layer 2.

The embossed article illustrated in FIG. 7 consists of a backing 1 and portions of metal layer 2 at the points subjected to electromagnetic and corpuscular radiation. This combination has been used for making such embossed articles as diffraction gratings, polarizers of electromagnetic radiation, phototemplets, printed plates, conducting elements of microcircuits, etc.

If the embossed article is used by arranging the layers in a reverse order, shown in FIG. 2, in this case the removal of the metal layer 2 which has not entered into chemical interaction with the layer 4 of inorganic matter and the removal of the barrier layer 3 at the points not subjected to radiation are followed by the removal of the layer 4 of inorganic matter at the points not, protected by the products 9 of interaction which are used as a protective mask. Then, if necessary, the products 9 of interaction are also removed. In this case the embossed article will be similar to that shown in FIG. 6 (the products are not removed) or in FIG. 7 (the products are removed) with a sole exception that the place of the portions of the metal layer 2 will be taken by the portions of the layer 4 of inorganic matter.

The method of manufacturing embossed articles of a preset configuration, according to the invention, is suitable for making articles with the depth of relief reaching several thousand Ångstroms.

Figure 8:
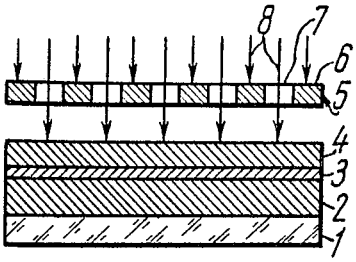
FIG. 8 is the diagram of exposure of the material shown in FIG. 2.
Figure 9:
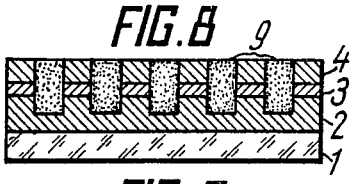
FIG. 9 shows the material after its exposure to actinic radiation.

The arrangement of layers and the diagram of projecting an image on them shown in FIG. 8 are the same as in FIG. 9 with the only exception that the thickness of the metal layer 2 is considerably greater than that of the layer 4 of inorganic matter. In this case the picture obtained after exposure is illustrated in FIG. 9. The thickness of the metal layer 2 being considerably greater than the layer 4 of inorganic matter, the products 9 of interaction in this case extend throughout the thickness of the layer 4 of inorganic matter and only through a part of the thickness of the metal layer 2. For example, if the metal layer 2 consists of silver with a thickness of several thousand Ångstroms, the barrier layer 3 consists of arsenic trisulphide 30 Å thick and the layer 4 of inorganic matter consists of arsenic triselenide 600 Å thick, then, after the exposure of this combination of layers in the course of 2 minutes to the radiation of a 250 W mercury lamp positioned at 30 cm from the work, the entire layer 4 will enter into chemical interaction with the layer 2 whereas only a part of the layer 2 will react chemically with the layer 4.

The exposure is followed by removing parts of the layer 4 that have not entered into chemical interaction with the layer 2, parts of the barrier layer 3 revealed after the removal of the parts of the layer 4, and the products of interaction. All these layers are removed by one or more etchants, specially selected for each layer. The etchants used for removing these layers are mentioned above in describing FIGS. 4 through 7.

Figure 10:
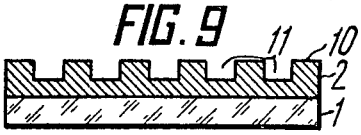
FIG. 10 shows the finished embossed article made from the material shown in FIG. 2.

The finished embossed article produced after the removal of these layers is shown in FIG. 10. This article consists of a backing 1 coated with a layer of metal 2 with projections 10 and recesses 11 to suit the present configuration. This arrangement has been used for making phase holograms (diffraction gratings), engraving plates, etc. The depth of relief in such embossed articles reaches 100–5000 Å.

Such gratings have been made, for example, on a layer of silver 3000 Å thick and on a layer of copper 5000 Å thick.

Figure 11:
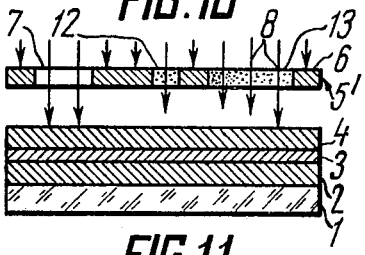
FIG. 11 shows the material similar to that shown in FIG. 1 and the diagram of its exposure through a stencil of nonuniform transparency.

FIG. 11 shows the combination of layers similar to that in FIG. 1 and a diagram of exposure of said layers through a stencil 5′ which has nonuniform transparency at different points. Thus, the stencil 5′ has non-transparent portions 6, transparent portions 7, semitransparent portions 12 and portions 13 with variable transparency. This scheme of radiation is realized for illuminating the layers through a conventional halftone negative or when recording holographic pictures of different objects.

Figure 12:
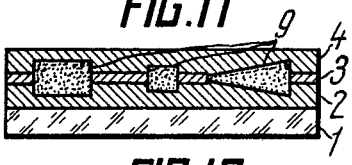
FIG. 12 shows the material after its exposure to actinic radiation.

FIG. 12 shows the combination of layers after exposure to electromagnetic irradiation through a stencil 5′ with nonuniform transparency at different points. In asmuch as the thickness of the products 9 of interaction is directly proportional to the time of exposure, it can be seen from FIG. 12 that the thickness of the products 9 of interaction at different points varies with the transparency of the portions of the stencil 5′.

Figure 13:
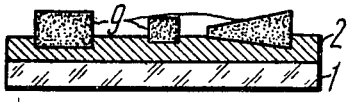
FIG. 13 shows the finished embossed article.

FIG. 13 shows the finished embossed article produced after the removal of the layer 4 of inorganic matter that has not entered into chemical interaction with the metal layer 2 and of the barrier layer 3 at the points not subjected to electromagnetic radiation. In this way the holograms of diffusely-scattering objects have been obtained. The holographic pictures have been recorded under the radiation of a helium-neon laser while the reduction of images has been performed in the radiation emitted by lasers (argon and helium-neon types mercury lamps with filters, and other sources.

Figure 14:
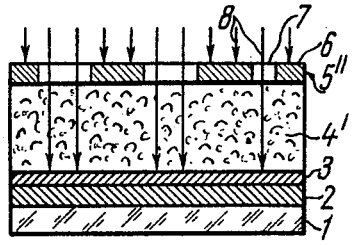
FIG. 14 shows the material whose layer of inorganic matter is in a gaseous phase, and the diagram of exposure of this material.

Shown in FIG. 14 is the combination of the layers of the material sensitive to electromagnetic and corpuscular radiation wherein the metal layer 2 and the barrier layer 3 are applied to a backing 1 while the layer 4′ of inorganic matter is in a gaseous phase and contacts the barrier layer 3. The same Figure illustrates a stencil 5″ through which radiation passes. This case is realized by putting the backing with the layer 2 and barrier layer 3 into a tightly-sealed vessel with vapours of inorganic matter. This is achieved by heating the vessel with an inorganic matter to a temperature sufficient for producing the required pressure of the vapours of said matter. If, for example, the layer 4 is made of arsenic trisulphide, the quartz vessel with this substance is heated to 250°–200° C.

Figure 15:
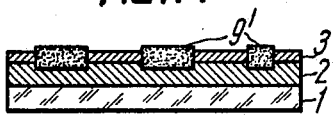
FIG. 15 shows the material similar to that represented in FIG. 14 after its exposure to actinic radiation.
Figure 16:
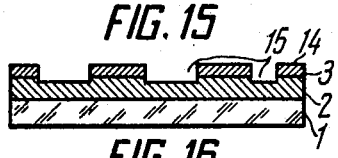
FIG. 16 shows the finished embossed article.

Under the effect of electromagnetic radiation passing through the transparent portions 7 of the stencil 5" the layer 4' of inorganic matter in a gaseous phase enters into chemical interaction with the metal layer 2 and forms the products 9 of interaction as shown in FIG. 15. In absence of electromagnetic radiation the barrier layer 3 interferes with chemical interaction between the layers 4' and 2. After the exposure, the backing 1 with the layer 2, barrier layer 3 and products 9 of interaction is withdrawn from the gaseous medium and this combination of layers forms a finished embossed article. If necessary, such an article is subjected to a further treatment, e.g. by removing the products 9 of interaction as shown in FIG. 16. The barrier layer may be left in place, particularly it if consists of a material resistant to the effect of the environment (e.g. Cr, Au, etc.). The embossed article has projections 14 and recesses 15.

Figure 17:
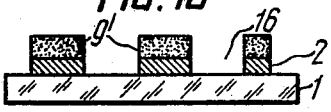
FIG. 17 shows the material similar to that represented in FIG. 15 after the removal of the barrier and metal layers at the nonexposed points.
Figure 18:
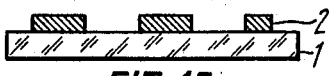
FIG. 18 shows the finished embossed article.

In another case the products 9' of interaction (FIG. 17) first are left in place and used as a protective mask while removing the portions of the barrier layer 2 of metal at the points 16 which have not been subjected to radiation; then the products 9' of interaction are removed to obtain a finished embossed article shown in FIG. 18.

In some cases when the products of interaction are volatile, the finished article is produced in the course of radiation, without additional treatment.

Figure 19:
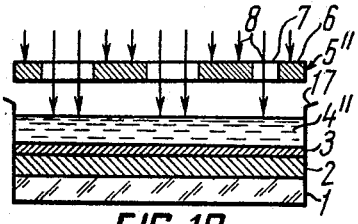
FIG. 19 shows the material whose layer of inorganic matter is in a liquid phase, and the diagram of exposure of this material.

FIG. 19 shows the combination of layers of a material sensitive to electromagnetic and corpuscular radiation wherein the metal layer 2 and the barrier layer 3 are applied to a backing 1 whereas the layer 4" of inorganic matter is in a liquid phase. This case is realized by immersing the backing 1 with the metal layer 2 and barrier layer 3 into a bath 17 with a molten inorganic matter. The liquid layer 4" of inorganic matter is applied to the barrier layer 3 also by coating the latter with a thin layer of powdered inorganic matter (e.g. the powder of arsenic triselenide finely crushed in a mortar) with subsequent heating of the backing with the layers 2, 3 and 4" to the melting point of the inorganic matter. The inorganic matter melts and spreads in a thin layer over the surface of the barrier layer 3.

Being acted upon by the electromagnetic radiation 8 passing through the transparent portions 7 of the stencil 5" (FIG. 19), the layer 4" of inorganic matter in a liquid phase interacts with the metal layer 2 and forms the products 9" of interaction. In absence of electromagnetic radiation the barrier layer 3 interferes with chemical interaction between the layers 4" and 2. After the exposure, the backing 1 with the layer 2, barrier layer 3 and products 9" of interaction (FIG. 20) is taken out of the liquid medium and washed in a solution which removes the settled particles of inorganic matter that have not entered into chemical interaction with the metal layer 2. This produced a finished embossed article illustrated in FIG. 20. If necessary, the products 9" of interaction are removed, this producing the embossed article shown in FIG. 21.

The method of manufacturing embossed articles of a preset configuration, according to the invention, is suitable for making embossed articles not only from the layers included into the material sensitive to electromagnetic and corpuscular radiation (i.e. metal layer 2 or layer 4 of inorganic matter) but also from the sublayer which differs from the layers 2 and 4. Shown in FIGS. 22 through 28 are the consecutive stages of manufacturing embossed articles, according to the invention, from the sublayer 18 which, in turn, is applied to the backing 1. Here the material sensitive to electromagnetic and corpuscular radiation is used as a photoresist for making a protective mask of the required configuration for the subsequent etching of the sublayer 18.

The method of manufacturing embossed articles of a preset configuration, according to the invention, consists in consequtive application to the backing 1 (FIG. 22) of a sublayer 18, metal layer 2, barrier layer 3 and a layer 4 of inorganic matter. The sublayer 18 may be made of metals, particularly of those most extensively used today in microelectronics and other fields (e.g. chromium, nickel, titanium, aluminium, etc.), dielectrics, semiconductors (silicon, germanium, gallium arsenide, etc.), organic films, etc. The sublayer 18 can be applied to the backing 1 as a separate layer trough, being sufficiently strong, it can serve as a backing itself, in which case there is no backing 1. The sublayer 18 is applied to the backing 1 by any known method (deposition in vacuo, chemical precipitation, melting, etc.). The layer 2, barrier layer 3 and the layer 4 of inorganic matter are applied by the same methods as those mentioned above in considering FIGS. 1 and 2. To produce an article of a high quality, the sublayer 18, metal layer 2, barrier layer 3 and the layer 4 of inorganic matter are applied in vacuo. In another case the sublayer 3 and layer 4 are applied by deposition in vacuo. In the third case the sublayer 18 is applied by chemical precipitation, the layers 2 and 4 by deposition in vacuo whereas the barrier layer 3, by dipping the work into a solution containing the substance of the barrier layer. Other combinations of the methods of application are possible as well.

In the method of manufacturing embossed articles of a preset configuration, according to the invention, it is also possible first to coat the sublayer 18 with a layer 4 of inorganic compound, then with a barrier layer 3 by any known method and only then with a metal layer 2. The layer 2, barrier layer 3 and layer 4 of inorganic matter are made of the substances mentioned above while considering FIGS. 1 and 2.

Figure 22:
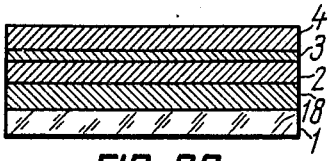
FIG. 22 shows the arrangement of the layers of the material applied to a sublayer which, in turn, is applied to a backing.
Figure 23:
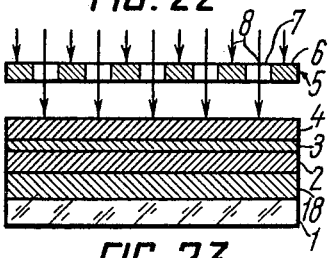
FIG. 23 shows the arrangement of the layers similar to that shown in FIG. 22, and the diagram of exposure.

FIG. 23 shows the combination of layers similar to that illustrated in FIG. 22 and a scheme of projecting an image including a stencil 5 with nontransparent portions 6 and transparent portions 7, and the electromagnetic or corpuscular radiation 8. The picture can be made on the layers by any known method (contact printing, conventional optical system, holographic method, etc.).

Figure 24:
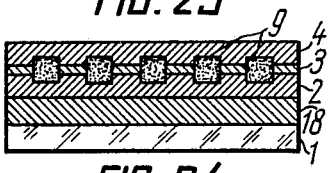
FIG. 24 shows the arrangement of layers after the exposure to actinic radiation.
Figure 25:
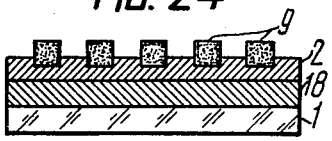
FIG. 25 shows the arrangement of the layers after the removal of the layer of inorganic matter and the barrier layer at the points not protected by the products of interaction.

Under the effect of electromagnetic and corpuscular radiation 8 passing through the transparent portions 7 of the stencil 5 (FIG. 23) the layer 4 of inorganic matter enters into chemical interaction with the metal layer 2 and forms the products 9 of interaction (FIG. 24). In absence of electromagnetic and corpuscular radiation 8 the barrier layer 3 prevents chemical interaction between the layers 4 and 2. The exposure is followed by removing the layer 4 of inorganic matter that has not entered into chemical interaction with the metal layer and removing the barrier layer 3 at the points not subjected to electromagnetic and corpuscular radiation 8 (FIG. 25). These layers are removed by the same methods as those mentioned above in describing FIGS. 4, 5, 12, 13 (chemical etching, mechanically, thermally, etc.).

If, for example, the layer 4 consists of arsenic triselenide and the barrier layer 3, of arsenic trisulphide, both layers are stripped with the aid of a 5–10% water solution of potassium hydroxide.

Figure 26:
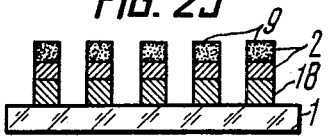
FIG. 26 shows the arrangement of the layers after the removal of the metal layer and sublayer at the points not protected by the products of interaction.

FIG. 26 shows the arrangement of the layers after the removal of the metal layer 2 and sublayer 18 at the points that have not been subjected to electromagnetic and corpuscular radiation 8. If the sublayer 18 consists of metal, the portions of layer 2 and sublayer 18 are removed with solutions of acids such as sulphuric, muriatic, hydrofluoric, nitric, or with a chrom-acid mixture, etc. For example, if the sublayer 18 is made of chromium and the layer 2 of silver, the 1% water solution of nitric acid is used for removing the portions of the metal layer (silver) and the 15% water solution of muriatic acid removes the portions of the sublayer 18 (chromium). In this case the products 9 of interaction are used as a protective mask while etching the layer 2 and sublayer 18.

Figure 27:
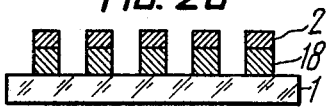
FIG. 27 shows the arrangement of the layers after the removal of the products of interaction.
Figure 28:
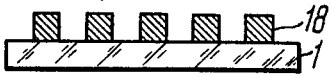
FIG. 28 shows the finished embossed article.

The above operation is followed by removing the products 9 of interaction and obtaining the combination of layers illustrated in FIG. 27, then by removing the portions of the layer 2 located under the products 9 of interaction and producing a finished embossed article illustrated in FIG. 28. The products 9 of interaction are stripped by chemical etching, mechanically or thermally. The metal layer 2 is stripped by chemical etching or by any other known method. For example, if the sublayer 18 is made of chromium, layer 2 of silver, barrier layer 3 of germanium disulphide, and layer 4 of arsenic triselenide, the layer 4 that has not entered into chemical interaction with the layer 2, and the portions of the barrier layer 3 at the points not subjected to radiation are removed with a 5–10% water solution of sodium hydroxide, the portions of the layer 2 at the points not protected by the products of interaction are removed with a 1% water solution of nitric acid, the exposed portions of the sublayer 18 are removed with a 15% water solution of sulphuric acid, the products 9 of interaction are removed with a concentrated water solution of ammonium hydroxide, the portions of the layer 2 located under the products of interaction are removed with a 1% water solution of nitric acid, thus producing the article shown in FIG. 28. This method was used for manufacturing phototemplets from chromium, nickel, copper. The method according to the invention is adapted for manufacturing optical elements such as diffraction gratings, polarizers of electromagnetic radiation, measuring microscales and grids, elements of microcircuits, engraving plates, etc.

To make the essence of the method according to the invention more apparent, it will be described in detail by considering the embodiments of its realization.

Example 1. A backing 1 (FIG. 1) in the form of a plane-parallel insulated glass plate $90\times60^{m}$ $m^2$ with a thickness of 2 mm was coated consecutively in vacuo ($2.10^{-5}$ mm Hg) with a layer 2 of silver 4000 Å thick, a barrier layer 3 of arsenic trisulphide 60 Å thick and a layer 4 of inorganic matter consisting of arsenic triselenide 600 Å thick. Then the sensitive material was exposed to an interference picture with a spatial frequency of 1200 lin/mm formed by two coherent beams of a helium-neon laser ($\lambda=6328$ Å). In FIG. 3 it is shown as radiation through a stencil 5 consisting of nontransparent portions 6 and transparent portsions 7. When the power of laser irradiation projected on the surface of the sensitive material was equal to $3.10^{-4}$ W/cm$^2$, the time of exposure required for blackening which corresponds to the maximum diffraction efficiency was equal to 30–40 s. Under the effect of electromagnetic radiation 8 the layers 3 and 4 entered into chemical interaction with the silver layer 2, forming the products 9 of interaction (FIG. 4). After the exposure, the backing 1 with the layers 2, 3 and 4 was dipped into a 10% water solution of potassium hyxdoxide to remove the portions of the layer 4 of arsenic triselenide and barrier layer 3 of arsenic trisulphide which did not enter into chemical interaction with the silver layer 2 (FIG. 5). Then the backing 1 with the layers was rinsed in distilled water and dried. This produced an amplitude-phase hologram in the form of a reflection-type diffraction grating.

If necessary, the solution consisting of 10 g of $K_2Cr_2O_7$, 50 g of $H_2SO_4$, 500 ml of $H_2O$ was used to remove the silver layer 2 at the points not protected by the products 9 of interaction (FIG. 6). If necessary, the products 9 of interaction were removed with the aid of a 25% water solution of $NH_4OH$. As a result of these operations, an embossed pattern consisting of strips of silver layer 2 was produced on the backing 1 (FIG. 7). Then the picture shown in FIG. 7 was coated with a layer of aluminium 2000 Å thick thus producing a purely phase grating featuring a high stability.

Example 2. A plastic backing 1 (FIG. 11) $80\times80$ mm$^2$, 3 mm thick, was coated consecutively in vacuo ($3.10^{-5}$ mm Hg) with a layer 2 of silver 1500 Å thick, a barrier layer 3 of germanium disulphide 40 Å thick and a layer 4 of arsenic triselenide 700 Å thick. Then a helium-neon laser ($\lambda=6328$ Å) was used to record a holographic image of a diffusely-scattering object (work holder). In FIG. 11 this is represented as irradiation through a stencil 5' with variable transparency at different points. The object was illuminated by a parallel beam of laser radiation ($6.10^{-4}$ W/cm$^2$) widened to 70 mm by a collimator; the light reflected by the object fell on the combination of layers. The layers were also illuminated by mirrors with a supporting beam reflected by a glass plate introduced into the main beam at an angle of 45°. The interference picture formed by the supporting wave and the wave reflected by the object was registered on the material sensitive to electromagnetic and corpuscular radiation. The time of exposure ranged from 2 to 3 minutes. The layers 3 and 4 entered into chemical interaction with silver layer 2 under the effect of electromagnetic radiation 8 and formed the products 9 of interaction (FIG. 12). Inasmuch as the time of exposure was constant for the entire surface, the thickness of the products 9 of interaction was directly proportional to the intensity of incident radiation. Then a 10% water solution of sodium hydroxide was used to remove the portion of the layer 4 of arsenic trisulphide and of the barrier layer 3 of germanium disulphide which did not enter into chemical interaction with the silver layer 2. Next, the sample was washed in distilled water and dried. This produced an embossed picture representing an amplitude-phase holgram of the object (FIG. 13). The holgraphic pictures of the objects proved to be of a high quality. They were reduced both by laser illumination and by the radiation of mercury lamps with filters.

Example 3. A backing 1 (FIG. 1) in the form of a plane-parallel plate of molten quartz $5\times50$ mm$^2$, 2 mm thick, was coated consecutively in vacuo ($4.10^{-5}$ Hg) with a copper layer 2 2000 Å thick, a barrier layer 3 of silver 40 Å thick and a layer 4 of arsenic trisulphide 450 Å thick. Then the combination of layers was exposed to an interference picture with a spatial frequency of 1800 lin/mm formed by two coherent beams of an argon laser ($\lambda=4880$ Å). In FIG. 3 this is represented as radiation through a stencil 5 with nontransparent portions 6 and transparent portions 7. With the power of laser radiation applied to the surface of the layer being equal to $2.10^{-3}$ W/cm$^2$, the time of exposure required for blackening which corresponds to a maximum diffraction efficiency ranged from 2 to 3 minutes. Under the effect of electromagnetic radiation 8 (FIG. 3) the layer 4 entered into chemical interaction with the layers 3 and 2, forming the products 9 of interaction (FIG. 4). After the exposure, a 2% water solution of potassium hydroxide was used to remove the portions of the layer of arsenic trisulphide that did not enter into chemical interaction with the layers 3 and 2. Then the barrier layer 3 of silver and the layer 2 of copper were removed from the points not protected by the products 9 of interaction by the solution comprising 10 g of $K_2Cr_2O_7$, 50 g of $H_2SO_4$ and 500 ml of $H_2O$. This produced an embossed picture on the backing (FIG. 6) constituting a diffraction grating. If necessary, the products of interaction were removed with a 25% water solution of $NH_4OH$. Then an embossed picture from copper appeared on the backing 1.

Example 4. A backing 1 (FIG. 14) in the form of a plane-parallel polished plate of molten quartz 60×60 mm², 5 mm thick, was coated consecutively in vacuo ($2.10^{-5}$ mm Hg) with a layer 2 of copper 3000 Å thick and a barrier layer 3 of chromium 40 Å thick. Then the backing 1 together with the layers 2 and 3 was placed into a quartz vessel filled with gaseous arsenic trisulphide at 260°-270° C. and at an atmospheric pressure. Using a photographic enlarger, the pattern of the stencil 5'' (FIG. 14) was projected on the combination of layers. The source of radiation was constituted by a 250 W high-pressure mercury lamp. At the points of irradiation the gaseous medium (layer 4') entered into chemical interaction with the layer 2 and formed the products 9' interaction. The barrier layer 3 prevented undue chemical interaction of the gaseous layer 4' with the layer 2 at the points not exposed to electromagnetic radiation. The time of exposure ranged from 1.5 to 2 minutes. Then the backing 1 with the layers 2, 3 and the products 9' of interaction was taken out of the vessel, the products 9' of interaction were removed with a 25% water solution of $NH_4OH$ thus producing the embossed article illustrated in FIG. 16. In a slightly modified version, the products 9' of interaction (FIG. 15) were at first left in place and served as a protective mask while etching the portions of the barrier layer 3 and layer 2 at the points not exposed to electromagnetic radiation (FIG. 17). The portions of the barrier layer 3 of chromium were removed in a 15% water solution of muriatic acid while the portions of the copper layer 2 were removed by a solution consisting of 10 g of $K_2Cr_2O_7$, 50 g of $H_2CO_4$ and 500 ml of $H_2O$. Then the products 9' of interaction themselves were removed with an etchant mentioned above in this example. This produced the embossed article illustrated in FIG. 18.

Figure 20:
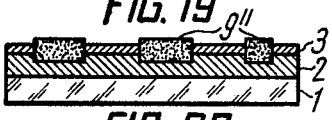
FIG. 20 shows the material similar to that represented in FIG. 19 after its exposure to actinic radiation.
Figure 21:
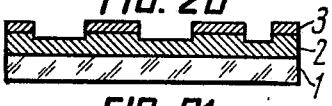
FIG. 21 shows the finished embossed article.

Example 5. A backing 1 (FIG. 19) in the form of a plane-parallel polished glass plate 50×50 mm², 3 mm thick, was coated consecutively in vacuo ($3.10^{-5}$ mm Hg) with a layer 2 of silver 2500 Å thick and a barrier layer 3 of chromium 30 Å thick. Then the backing 1 with the layers 2 and 3 was placed horizontally into a quartz bath 17 with the layers 3 and 2 on the top. The surface of the barrier layer 3 was coated with a thin layer of powdered arsenic triselenide, then the backing 1 with the layers 2 and 3 and the powder was heated (by heating the bath 17) to the melting point of arsenic triselenide (360° C.). At this temperature arsenic triselenide melted and spread in a liquid layer 4'' over the surface of the barrier layer 3. Then the pattern of the stencil 5'' was projected on the combination of layers with the aid of a photographic enlarger (FIG. 19). The source of radiation was constituted by a 500 W high-pressure xenon lamp. At the points exposed to radiation the liquid layer 4'' interacted chemically with the layer 2 and formed the products 9'' of interaction (FIG. 20). The barrier layer 3 prevented undue chemical interaction between the liquid layer 4'' and the layer 2 at the points not exposed to electromagnetic radiation. The time of exposure varied from 20 to 30 s. After exposure, the system of layers was taken out of the bath 17, the products 9'' of interaction were removed with a 25% water solution of $NH_4OH$ and the embossed article illustrated in FIG. 21 was produced.

Example 6. A backing 1 (FIG. 1) in the form of nickel foil 1 mm thick was coated in vacuo ($1.10^{-5}$ mm Hg) with a layer 2 of alloy $Ag_{70}Mn_{30}$, 1500 Å thick. Then the backing 1 with the layer 2 was immersed in a 1% alcohol solution of colophony, taken out and dried which produced a thin barrier layer 3. Then a layer 4 of chalkohenide glass $As_{35}Se_{55}J_{10}$, 700 Å thick, was applied in a vacuum of $3.10^{-5}$ mm Hg. The system of layers was exposed to interference picture with spatial frequency of 1600 lin/mm formed by two coherent beams of a helium-neon laser (λ=6328 Å). With the power of laser illumination directed on the surface of the layer 4 being equal to $3.10^{-4}$ W/cm² the time of exposure ranged from 3 to 4 minutes. After the exposure, the portions of the layer 4 that did not enter into chemical interaction with the layer 2 were removed with a 5% water solution of potassium hydroxide. This produced an amplitude-phase hologram in the form a diffraction grating.

Example 7. A copper plate 80×80 mm², 4 mm thick, was coated consecutively in vacuo ($2.10^{-5}$ mm Hg) with a barrier layer 3 of SiO, 40 Å thick, and a layer of germanium diselenide, 650 Å thick. The system of layers was illuminated by an interference picture formed by the laser beams as in the preceding example. The time of exposure was 5-6 min. After the exposure the portions of the layer of germanium diselenide that did not enter into chemical interaction with copper were removed with a 10% water solution of potassium hydroxide. This produced an amplitude-phase hologram in the form of a diffraction grating.

Example 8. A backing (FIG. 22) in the form of a plane-parallel polished glass plate 70×70 mm², 4 mm thick, was coated by chemical precipitation with a chromium sublayer 18, 2000 Å thick then it was consecutively coated in a vacuum of $2.10^{-5}$ mm Hg with a silver layer 2, 1200 Å thick, a barrier layer 3 of arsenic pentasulphide 50 Å thick and a layer 4 of arsenic triselenide 500 Å thick. Then the layers were illuminated through the stencil 5 (FIG. 23) by a 250 W mercury lamp located at a distance of 20 cm from the layers. The time of exposure was 10-20 s. The products 9 of interaction were formed in the points exposed to radiation (FIG. 24). Then the portions of the layer 4 of arsenic triselenide and of the barrier layer 3 of arsenic pentasulphide that did not enter into chemical interaction with the silver layer 2 were stripped with a 10% water solution of potassium hydroxide (FIG. 25). The portions of the silver layer 2 at the points not protected by the products of interaction were removed with a 1% water solution of nitric acid and the portions of the sublayer 18 (FIG. 26) were removed with a 15% water solution of muriatic acid at the same points. This produced a phototemplet with transparent and nontransparent portions.

If necessary, the products 9 of interaction were removed with a 30% water solution of ammonium hydroxide. Besides, the remaining portions of the silver layer 2 were also removed with a 1% water solution of nitric acid thus producing a highly stable chromic phototemplet illustrated in FIG. 28.

Example 9. A plane-parallel glass plate 40×40 $mm^2$ with a thickness of 2 mm in vacuo ($3.10^{-5}$ mm Hg) through a mask screening ¼ of the plate was coated with a layer of gold 1500 Å thick, then the mask was shifted to the other end of the backing plate and a layer of arsenic triselenide 3000 Å thick was made on it, this layer covering the free portion of the backing plate and most of the gold layer. Then the mask was used to cover the free portion of the gold layer and the portion of the arsenic triselenide layer found above the gold layer, and thereupon a 200 Å aluminium layer and a 250 Å silver layer were produced. With the aid of a silver paste contacts were fitted to the silver layer and to the free portion of the gold layer for applying an electric field. Then the image of a stencil was projected onto the material. As a radiation source use was made of a 40 mW helium-neon laser. With no electric field applied, the radiation sensitivity of the material was low, since the aluminium barrier layer interfered with the chemical interaction between the layers of arsenic triselenide and silver in case of no electromagnetic radiation, and strongly weakened this interaction in case of electromagnetic radiation present.

With an electric field applied to the material, the sensitivity of the system to the helium-neon laser radiation sharply grew, since the influence of the barrier layer diminished, and the stencil image was recorded during a few seconds. It should be noted that an increase in the sensitivity of the material was observed only when a positive potential was fed to the upper (aluminium-silver) electrode. The voltage fed to the electrodes from a d.c. source was 8 to 10 V. After the exposure with the aid of a solution containing 15 g of $K_2Cr_2O_7$, 60 g of $H_2SO_4$ and 500 ml of $H_2O$, the layer of silver that had not reacted with the arsenic triselenide layer was removed, and then, using a 5% aqueous solution of KOH, the aluminium layer was removed in those places which were not protected by the interaction products, the arsenic triselenide layer being subsequently etched to a certain depth (depending on the etching time). The result of the above-described procedures was a deeply embossed article.

What we claim is:

1. A method of manufacturing embossed articles of a preset configuration with the use of material sensitive to actinic electromagnetic and corpuscular radiation consisting essentially of the following operations: application of a metal layer to a backing; coating said metal layer with a barrier layer consisting of matter chemically different from that of said metal layer; coating said barrier layer with a layer of inorganic matter containing a substance selected from the group consisting of sulfur, selenium, and selenium and halogen, said inorganic matter chemically different from the barrier layer and will react chemically with said metal layer in the absence of the barrier layer to form the products of interaction whose physical and chemical properties differ from those of said metal layer and the layer of inorganic matter; wherein the barrier layer is of sufficient thickness in the range of 20–300 Å to permit said chemical interaction only in the presence of actinic electromagnetic or corpuscular radiation; projecting a pattern of a preset configuration on said applied layers; exposure; removal of unnecessary portions of said layers until an embossed article of a preset configuration is produced.

2. A method of manufacturing embossed articles of a preset configuration according to claim 1 wherein said barrier layer is applied by treating the surface of the metal layer in the atmosphere of a gaseous substance selected from the group consisting of oxygen and/or fluorine, chlorine, bromine, iodine, sulphur, selenium, tellurium taken separately or in combination.

3. A method of manufacturing embossed articles of a preset configuration according to claim 1 wherein said barrier layer is applied by deposition in vacuo.

4. A method of manufacturing embossed articles of a preset configuration according to claim 1 wherein said barrier layer is applied by chemical precipitation.

5. A method of manufacturing embossed articles of a preset configuration according to claim 1 wherein said barrier layer is applied by dipping the work into a solution containing the substance of said barrier layer.

6. A method of manufacturing embossed articles of a preset configuration according to claim 1 wherein said barrier layer is applied by dipping the work into a chemically-active liquid medium.

7. A method of manufacturing embossed articles of preset configuration according to claim 1 wherein the actinic radiation is of the red and near infra-red regions of the spectrum.

8. A method of manufacturing embossed articles of a preset configuration with the use of a material sensitive to actinic electromagnetic and corpuscular radiation consisting essentially of the following operations: applying a layer of metal to a backing; coating said metal layer with a barrier layer consisting of matter differing from that of said metal layer; coating said barrier layer with a layer of inorganic matter containing a substance selected from the group consisting of sulfur, selenium, and selenium and halogen, said inorganic matter differing from the matter of said barrier layer and capable of interacting chemically with said metal layer and forming the products of interaction whose physical and chemical properties differ from those of said metal layer and the layer of inorganic matter; the thickness of said said barrier layer in the range of 20–300 Å is such as to permit said chemical interaction only in the presence of said electromagnetic or corpuscular radiation; projecting a pattern of a preset configuration on said applied layers; exposure; removal of unnecessary protions of said layers until the embossed article of a preset configuration is produced.

9. A method of manufacturing embossed articles of a pre-set configuration according to claim 8 wherein said barrier layer is applied by pouring.

10. A method of manufacturing embossed articles of a pre-set configuration according to claim 8 wherein said exposure is followed by removing said layer of inorganic matter that has not entered into chemical interaction with said layer of metal while said barrier layer at the non-exposed points is removed after the removal of said layer of inorganic matter.

11. A method of manufacturing embossed articles of a pre-set configuration according to claim 10 wherein the unnecessary portions of said barrier layer are removed by chemical etching.

12. A method of manufacturing embossed articles of a pre-set configuration according to claim 10 wherein the unnecessary portions of said barrier layer are removed mechanically.

13. A method of manufacturing embossed articles of a pre-set configuration according to claim 10 wherein the unnecessary portions of said barrier layer are removed by thermal sublimation.

14. A method of manufacturing embossed articles of a pre-set configuration according to claim 8, wherein during said exposure an electric field is applied to said material.

15. A method of manufacturing embossed articles of preset configuration according to claim 8 wherein the electromagnetic and corpuscular radiation is of the red and near infra-red regions of the spectrum.

16. A method of manufacturing embossed articles of a preset configuration with the use of a material sensitive to actinic electromagnetic and corpuscular radiation consisting essentially of the following operations: applying a layer of inorganic matter containing a substance selected from the group consisting of sulfur, selenium, and selenium and halogen to a backing; coating said layer of inorganic matter with a barrier layer consisting of matter different from that of said layer of inorganic matter; coating said barrier layer with a layer of metal which differs from the matter of said barrier layer and is capable of interacting chemically with said layer of inorganic matter and forming the products of interaction whose physical and chemical properties differ from those of said metal layer and the layer of inorganic matter; the thickness of said barrier layer in the range of 20–300 Å is such as to permit said chemical interaction only in the presence of electromagnetic or corpuscular radiation; projecting a pattern of a preset configuration on said applied layers; exposure; removal of unnecessary portions of said layers until an embossed article of a preset configuration is produced.

17. A method of manufacturing embossed articles of a pre-set configuration according to claim 16 wherein said barrier layer is applied by pouring.

18. A method of; manufacturing embossed articles of a pre-set configuration according to claim 16 wherein said exposure is followed by removing said layer of metal that has not entered into chemical interaction with said layer of inorganic matter while said barrier layer at the non-exposed points is removed after the removal of said metal layer.

19. A method of manufacturing embossed articles of a pre-set configuration according to claim 18 wherein the unnecessary portions of said barrier layer are removed by chemical etching.

20. A method of manufacturing embossed articles of a pre-set configuration according to claim 18 wherein the unnecessary portions of said barrier layer are removed mechanically.

21. A method of manufacturing embossed articles of a pre-set configuration according to claim 18 wherein the unnecessary portions of said barrier layer are removed by thermal sublimation.

22. A method, of manufacturing embossed articles of a pre-set configuration according to claim 16, wherein during said exposure an electric field is applied to said material.

23. A method of manufacturing embossed articles of preset configuration according to claim 16 wherein the electromagnetic and corpuscular radiation is of the red and near infra-red regions of the spectrum.

24. A method for manufacturing embossed articles of a preset configuration with the use of a material sensitive to actinic electromagnetic and corpuscular radiation consisting essentially of: applying to a backing a metal layer selected from the group consisting of silver, gold, copper, chromium, manganese and aluminum; coating said metal layer with a barrier layer material chemically different from said metal layer and selected from the group consisting of arsenic trisulfide, chromium, germanium, diselenide, arsenic triselenide, germanium disulfide, colophony, silicon oxide, and arsenic pentasulfide; coating said barrier layer with a layer of inorganic material containing a substance selected from the group consisting of sulfur, selenium, and selenium and halogen, wherein said inorganic material is chemically different from the material of said barrier layer and will chemically react with the metal layer in the absence of the barrier layer to form products of reaction whose physical and chemical properties differ from the metal layer and the layer of inorganic material; and wherein the barrier layer is of sufficient thickness in the range of 20–300 Å, to permit said chemical reaction only in the presence of actinic radiation; projecting a pattern of a preset configuration on said applied layers; exposure; removal of unnecessary portions of said layers until an embossed article of a preset configuration is produced.

25. A method of manufacturing embossed articles of a preset configuration according to claim 24 wherein said barrier layer is applied by dipping the work into a solution containing the substance of said barrier layer.

26. A method of manufacturing embossed articles of a preset configuration according to claim 24 wherein said barrier layer is applied by dipping the work into, a chemically-active liquid medium.

27. The method of claim 24 wherein the inorganic material is selected from the group consisting of arsenic trisulfide, arsenic triselenide and germanium diselenide.

28. The method of claim 24 wherein the metal layer is selected from the group consisting of: silver, copper, silver-manganese alloy, and gold; the barrier layer is selected from the group consisting of: arsenic sulfides, germanium sulfides, silicon oxide, chromium, silver and colophony; and the inorganic layer is selected from the group consisting of: arsenic selenides, arsenic sulfides, germanium selenides, and silver-aluminum alloys.

29. The method of claim 28 wherein the metal-barrier-inorganic layers, respectively, are selected from the group consisting of:

silver-arsenic trisulfide-arsenic triselenide,
copper-chromium-arsenic trisulfide,
silver-arsenic trisulfide-germanium diselenide,
silver-germanium disulfide-arsenic triselenide,
copper-silver-arsenic trisulfide,
copper-chromium-arsenic trisulfide,
silver-chromium-arsenic triselenide,
$Ag_{70}Mn_{30}$-colophony-$As_{35}Se_{55}J_{10}$,
copper-silicon oxide-germanium diselenide,
silver-arsenic pentasulfide-arsenic triselenide, and
gold-arsenic triselenide-silver aluminum.

* * * * *